US011480900B2

(12) United States Patent
Tanaka et al.

(10) Patent No.: US 11,480,900 B2
(45) Date of Patent: Oct. 25, 2022

(54) IMAGE FORMING APPARATUS

(71) Applicant: CANON KABUSHIKI KAISHA, Tokyo (JP)

(72) Inventors: Kenichi Tanaka, Ibaraki (JP); Keita Kondo, Ibaraki (JP); Yuki Inoue, Ibaraki (JP); Shingo Katano, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/228,818

(22) Filed: Apr. 13, 2021

(65) Prior Publication Data

US 2021/0356887 A1 Nov. 18, 2021

(30) Foreign Application Priority Data

May 18, 2020 (JP) ..... JP2020-086682
May 18, 2020 (JP) ..... JP2020-086683
Apr. 6, 2021 (JP) ..... JP2021-064781

(51) Int. Cl.
*G03G 15/20* (2006.01)
*G03G 15/00* (2006.01)

(52) U.S. Cl.
CPC ..... *G03G 15/2053* (2013.01); *G03G 15/2064* (2013.01); *G03G 15/757* (2013.01); *G03G 2215/2032* (2013.01)

(58) Field of Classification Search
CPC ..... G03G 15/2017; G03G 15/2032; G03G 15/2039; G03G 15/2053; G03G 15/6573; G03G 2215/2003
See application file for complete search history.

(56) References Cited

U.S. PATENT DOCUMENTS

| | | | |
|---|---|---|---|
| 5,168,290 | A | 12/1992 | Tanaka et al. |
| 5,171,969 | A | 12/1992 | Nishimura et al. |
| 5,239,347 | A | 8/1993 | Onodera et al. |
| 5,555,082 | A | 9/1996 | Tanaka et al. |
| 2011/0026971 | A1 | 2/2011 | Ino et al. |
| 2015/0075207 | A1 | 3/2015 | Karikusa et al. |

FOREIGN PATENT DOCUMENTS

| | | | |
|---|---|---|---|
| JP | 2009-181055 | A | 8/2009 |
| JP | 2010-002644 | A | 1/2010 |
| JP | 2014-203016 | A | 10/2014 |
| JP | 2014-227258 | A | 12/2014 |
| JP | 6124122 | B2 | 5/2017 |

OTHER PUBLICATIONS

Aug. 9, 2021 European Search Report in European Patent Appln. No. 21168261.2.

*Primary Examiner* — Thomas S Giampaolo, II
(74) *Attorney, Agent, or Firm* — Venable LLP

(57) ABSTRACT

An image forming apparatus includes a fixing device and a cooling device provided on a side downstream of the fixing device with respect to a sheet feeding direction. The cooling device includes a first unit including a first belt and a first roller, a second unit including a second belt for forming a nip in cooperation with the first belt, a heat sink and a second roller, and a driving motor for rotating the first roller and the second roller. The second unit is movable between a contact position where the first belt and the second belt are in contact with each other so as to form the nip and a separated position where the first belt and the second belt are in separation from each other so as to release the nip.

16 Claims, 8 Drawing Sheets

IMAGE FORMING APPARATUS

FIELD OF THE INVENTION AND RELATED ART

The present invention relates to an image forming apparatus including a sheet cooling device capable of nipping and feeding a recording material by a pair of belts rotatable in contact with each other, suitable for use the image forming with apparatus, such as a printer, a copying machine, a facsimile machine or a multi-function machine.

Conventionally, in an image forming apparatus for forming an image on the recording material, a sheet feeding device of a belt type in which the recording material (also called a sheet) is nipped and fed by the pair of belts rotating in contact with each other is employed. In order to prevent adhesion between recording materials stacked on, for example, a discharge tray, the sheet feeding device is employed in a recording material cooling device or the like in which a temperature of the recording material is lowered (Japanese Laid-Open Patent Application 2009-181055). In this device, in the case where drive of a pair of belts is stopped in a state in which the recording material is nipped between the pair of belts (so-called a jam), in order to permit a user to remove the recording material nipped by the belts, these belts are provided so as to be movable between a contact position where one of the belts is contacted to the other belt and a separated position where one of the belts is separated from the other belt.

Thus, in the case where a constitution in which one belt is movable between the contact position and the separated position relative to the other belt is employed, in general, a constitution in which a driving motor for driving one belt and a driving motor for driving the other belt are provided on opposite sides, respectively, would be considered.

In the case of such a constitution, the driving motor has to be mounted in each of both of belt units, so that an increase in cost is invited. Therefore, a constitution in which the number of motors is decreased by driving both the belt units by a single driving motor would be considered, but a constitution in which in a cooling device in which one of the belt units is movable, both the belt units are driven by a single motor has not yet been proposed.

SUMMARY OF THE INVENTION

A principal object of the present invention is to provide an image forming apparatus including a cooling device employing a constitution in which a pair of belt units is driven by a single motor.

According to an aspect of the present invention, there is provided an image forming apparatus comprising: a fixing device configured to fix a toner image on a sheet by heating the sheet; and a cooling device provided on a side downstream of the fixing device with respect to a sheet feeding direction, the cooling device comprising: a first unit including a first belt and a first roller for stretching and rotating the first belt; a second unit including a second belt for forming a nip in which the sheet is nipped and fed in cooperation with the first belt, a heat sink contacting an inner peripheral surface of the second belt, and a second roller for stretching and rotating the second belt, wherein the second unit is movable between a contact position where the first belt and the second belt are in contact with each other so as to form the nip and a separated position where the first belt and the second belt are in separation from each other so as to release the nip; and a driving motor configured to rotate the first roller and the second roller.

Further features of the present invention will become apparent from the following description of exemplary embodiments with reference to the attached drawings.

DESCRIPTION OF EMBODIMENTS

<Image Forming Apparatus>

Figure 1:
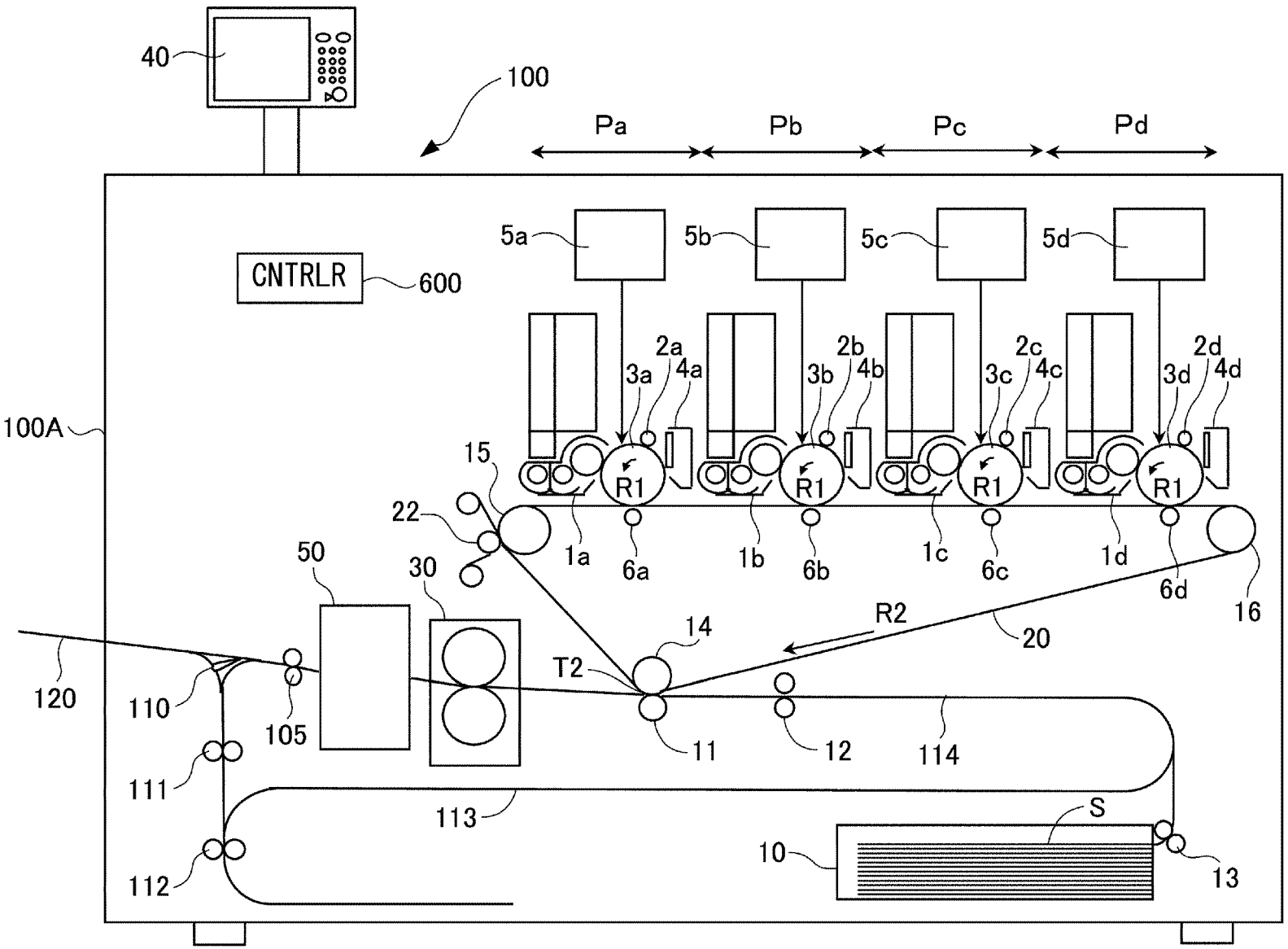
FIG. 1 is a schematic view showing an image forming apparatus to which a sheet feeding device according to an embodiment of the present invention is applicable.

In the following, an embodiment of the present invention will be described with reference to the drawings. First, a structure of an image forming apparatus to which a sheet feeding device of this embodiment is applicable will be described with reference to FIG. 1. An image forming apparatus 100 shown in FIG. 1 is an electrophotographic full-color printer of a tandem type. The image forming apparatus 100 includes image forming portions Pa, Pb, Pc and Pd for forming images of yellow, magenta, cyan and black, respectively. The image forming apparatus 100 forms a toner image on a recording material S in accordance with image information from an original reading device (not shown) connected to an apparatus main assembly 100A or from an external device (not shown) such a personal computer communicatably connected to the apparatus main assembly 100A. As the recording material S, it is possible to use sheet materials of various kinds, such as sheets including plain paper, thick paper, roughened paper, uneven paper and coated paper; plastic films; and cloths.

A recording material feeding process of the image forming apparatus 100 will be described. The recording material S is accommodated in a sheet feeding cassette 10 in a stacked form, and is sent from the sheet feeding cassette 10 in synchronism with image forming timing by a sheet feeding roller 13. The recording material S fed by the sheet feeding roller 13 is fed to a registration roller pair 12 disposed in an intermediary portion of a feeding passage 114. Then, the recording material S is subjected to oblique movement correction and timing correction by the registration roller pair 12, and thereafter is sent to a secondary transfer portion T2. The secondary transfer portion T2 is a transfer nip formed by an inner secondary transfer roller 14 and an outer secondary transfer roller 11, and the toner image is transferred onto the recording material S in response to application of a secondary transfer voltage to the outer secondary transfer roller 11.

Separately from the above-described feeding process of the recording material S to the secondary transfer portion T2, an image forming process of an image sent to the secondary transfer portion T2 at similar timing will be described. First, the image forming portions will be described, but the respective color image forming portions Pa, Pb, Pc and Pd are substantially constituted similarly except that colors of toners used in developing devices 1*a*, 1*b*, 1*c* and 1*d* are yellow, magenta, cyan and black, respectively. Therefore, in the following, as a representative example, the black image forming portion Pd is described, and other image forming portions Pa, Pb and Pc will be omitted from description.

The image forming portion Pd is principally constituted by the developing device 1*d*, a charging device 2*d*, a photosensitive drum 3*d*, a photosensitive drum cleaner 4*d*, and an exposure device 5*d* and the like. In FIG. 1, a surface of the photosensitive drum 3*d* rotated in an arrow R2 direction is electrically charged uniformly in advance by the charging device 2*d*, and thereafter, an electrostatic latent image is formed by the exposure device 5*d* driven on the basis of a signal of the image information. Then, the electrostatic latent image formed on the photosensitive drum 3*d* is developed into the toner image with a developer by the developing device 1*d*. Then, in response to application of a primary transfer voltage to a primary transfer roller 6*d* provided opposed to the image forming portion Pd through an intermediary transfer belt 20, the toner image formed on the photosensitive drum 3*d* is primary-transferred onto the intermediary transfer belt 20. Primary transfer residual toner slightly remaining on the photosensitive drum 3*d* is collected by the photosensitive drum cleaner 4*d*, and the image forming portion Pd prepares for a subsequent image forming process.

The intermediary transfer belt 20 is stretched by the inner secondary transfer roller 14, a tension roller 15 and a stretching roller 16 and is driven in an arrow R2 direction in FIG. 1. In the case of this embodiment, the stretching roller 16 also functions as a driving roller for driving the intermediary transfer belt 20. The respective color image forming processes performed in parallel by the image forming portions Pa to Pd are carried out at timings each when the toner image is superposed onto the toner image, of an upstream color, which is primary-transferred on the intermediary transfer belt 20. As a result, consequently, a full-color toner image is formed on the intermediary transfer belt 20 and is fed to the secondary transfer portion T2. Incidentally, secondary transfer residual toner passed through the secondary transfer portion T2 is collected by a transfer cleaner (device) 22.

As described above, by the feeding process and the image forming process which are described above, the timing of the recording material S and the timing of the full-color toner image coincide with each other at the secondary transfer portion T2, so that secondary transfer is carried out. Thereafter, the recording material S is fed to a fixing device 30, in which predetermined pressure and predetermined heat quantity are applied, so that the toner image is fixed on the recording material S. The fixing device 30 nips and feeds the recording material S on which the toner image is formed and thus heats and presses the fed recording material S, so that the toner image is fixed on the recording material S. That is, the toners for the full-color toner image formed on the recording material S are melted and mixed by heating and pressing, and are fixed as a full-color image on the recording material S. Thus, a series of operations of the image forming process is ended. Incidentally, in the case of this embodiment, the recording material S on which the toner image is fixed is fed from the fixing device 30 toward a recording material cooling device 50, and is then cooled. For example, a temperature of the recording material S is about 90° C. immediately in front of the recording material cooling device 50, but is lowered to about 60° C. after the recording material S passes through the recording material cooling device 50.

In the case of one-side image formation, the recording material S cooled by the recording material cooling device 50 is fed by a pair of discharging rollers 105 and is discharged onto a sheet discharge tray 120 as it is. On the other hand, in the case of double-side image formation, by a switching member 110 (which is called a flapper or the like), a sheet feeding passage is switched from a passage continuous toward the sheet discharge tray 120 to a passage continuous to a double-side leading roller pair 111, so that the recording material S nipped and fed by the discharging roller pair 105 is sent toward the double-side leading roller pair 111. Thereafter, a leading end and a trailing end of the recording material S are changed to each other by a reversing roller pair 112 and is sent to the feeding passage 114 again through a double-side passage 113. As regards subsequent feeding process and an image forming process of the image on a back surface (second surface) of the recording material S, these processes are similar to those described above, and therefore, will be omitted from description.

<Recording Material Cooling Device>

Figure 2:
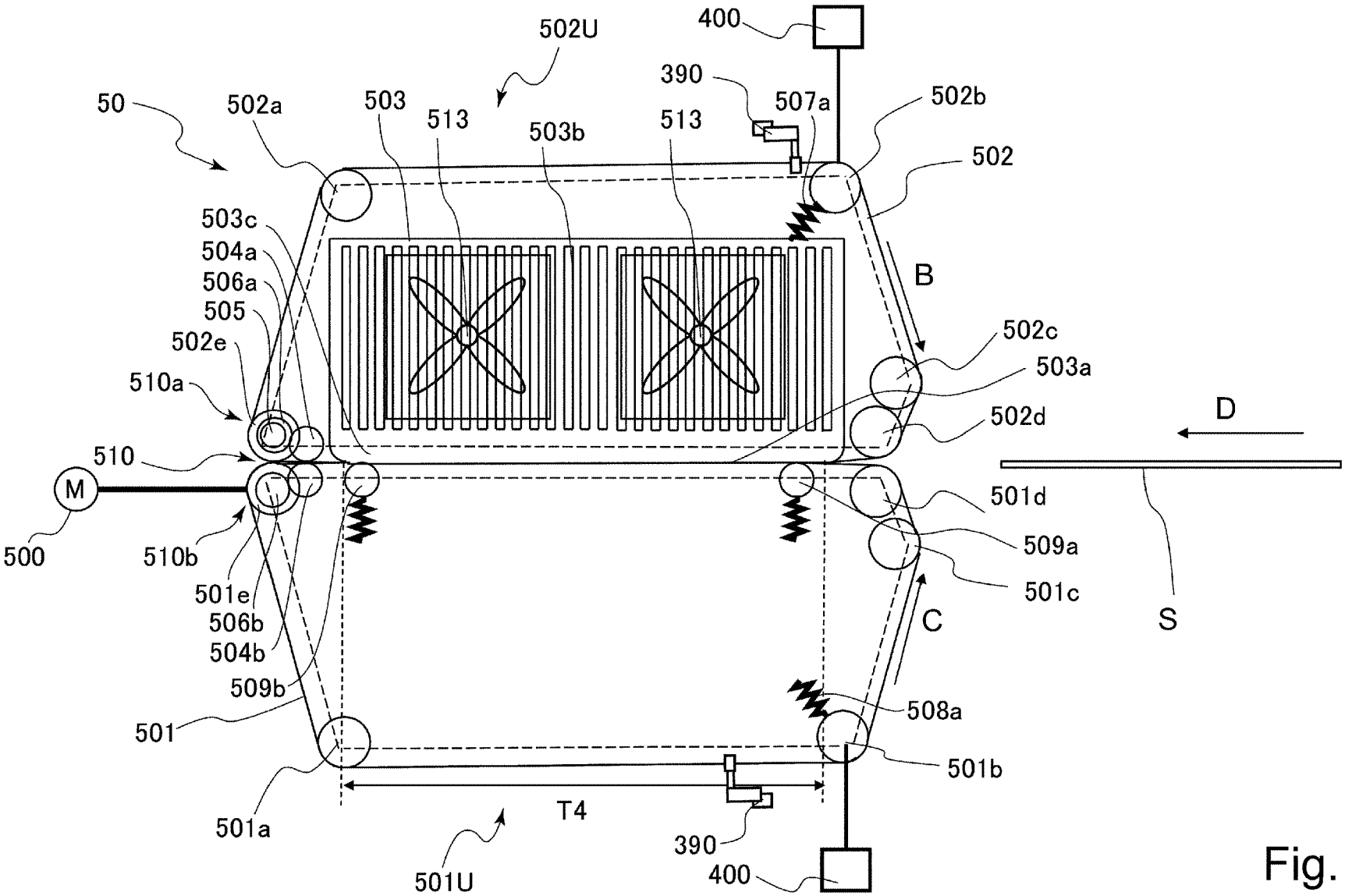
FIG. 2 is a schematic view showing a recording material cooling device.

Next, in the sheet feeding device of this embodiment, the recording material cooling device 50 will be described as an example by using FIGS. 2 to 7. The recording material cooling device 50 described below is a cooling device of a belt cooling type. As shown in FIG. 2, the recording material cooling device 50 includes an endless second belt 502 and an endless first belt 501 for nipping and feeding the recording material S in cooperation with the second belt 502. For example, each of the second belt 502 and the first belt 501 is formed of a polyimide resin material high in strength and is set so as to have a thickness of 100 μm and a peripheral length of 942 mm. Further, the recording material cooling device 50 includes a heat sink 503 as a cooling means for cooling the second belt 502. In the case of this embodiment, the heat sink 503 contacts the second belt 502 contactable to the recording material S on a side where the toner image is fixed by the fixing device 30 (FIG. 1). Incidentally, the cooling means is not limited to the cooling means for cooling the second belt 502 by the heat sink 503. For example, the cooling means may also be a belt fan capable of cooling the second belt 502 by blowing the air to the second belt 502.

The first belt 501 is stretched around a plurality of first belt stretching rollers 501*a* to 501*e*, and one of the first belt stretching rollers 501*a* to 501*e* is rotated through a roller driving portion 500 connected to a driving motor M. The roller driving portion 500 includes, for example, belt members and gear portions for transmitting rotation (rotational force) of the driving motor M, and in the case of this embodiment, these members and portions and provided on one end portion side of the first belt stretching roller 501*e* with respect to a rotational axis direction. The roller driving portion 500 is capable of rotating the first belt stretching roller 501*e* counterclockwise in FIG. 2 in response to rotation of the driving motor M. Thus, the first belt stretching roller 501*e* functions as a driving roller for driving the first belt 501.

Further, in this embodiment, a driving gear portion 510 is provided on the other end portion side of the second belt stretching roller 502*e* (second roller) and the first belt stretching roller 501*e* (first roller) with respect to the rotational axis direction. The driving gear portion 510 is provided for rotating the second belt 502 by transmitting a rotational driving force of the first belt stretching roller 501*e* rotating in synchronism with the driving motor M, to the second belt stretching roller 502*e* described later. The driving gear portion 510 will be specifically later.

On the other hand, the second belt 502 is stretched around a plurality of second belt stretching rollers 502*a* to 502*e* and is capable of contacting the first belt 501. In the case of this embodiment, the second belt stretching roller 502*e* is rotated in accordance with transmission of the rotational driving force by the driving gear portion 510, whereby the second belt 502 is rotated in an arrow B direction. That is, the second belt 502 and the first belt 501 are rotated in the same direction in a cooling nip T4 in response to the driving motor M which is the same driving source. Incidentally, in the case of this embodiment, the second belt stretching roller 502*e* and the first belt stretching roller 501*e* which are connected to each other by the driving gear portion 510 so as to permit drive transmission therebetween do not contribute to formation of the cooling nip T4. That is, the second belt stretching roller 502*e* and the first belt stretching roller 501*e* are disposed out of a range of the cooling nip T4 with respect to the feeding direction of the recording material S and do not form the cooling nip T4.

In this embodiment, the second belt stretching roller 502*b* and the first belt stretching roller 501*b* are steering rollers provided for controlling shifts of the second belt 502 and the first belt 501, respectively. These steering rollers 502*b* and 501*b* press the second belt 502 and the first belt 501, respectively, from an inner peripheral surface side toward an outside of the associated belt so that tension of each of the second belt 502 and the first belt 501 is, for example, about 39.2 N (about 4 kgf). In order to do so, the second belt stretching roller 502*b* is urged by a spring 507*a*, and the first belt stretching roller 501*b* is urged by a spring 508*a*. The steering rollers 502*b* and 501*b* are separately steered by steering mechanisms 400 so as to provide a steering angle based on a central portion thereof as a rotation supporting portion with respect to the rotational axis direction (widthwise direction), so that meandering of each of the second belt 502 and the first belt 501 is controlled.

On an inner peripheral surface side of the first belt 501, pressing rollers 509*a* and 509*b* for pressing the first belt 501 toward the heat sink 503 of a second unit 502U are provided. The pressing rollers 509*a* and 509*b* as pressing members press the first belt 501 at pressure of 9.8 N (1 kgf). By this, the second belt 502 is pressed toward the heat sink 503 (specifically a heat receiving portion 503*a* described later) through the first belt 501, so that the cooling nip T4 can be formed with reliability.

The recording material S on which the toner image is fixed is nipped between the second belt 502 and the first belt 501 and is fed in a feeding direction (arrow D direction in the figure) by rotation of these belts. During the feeding, the recording material S passes through the cooling nip T4 formed by the second belt 502 and the first belt 501. In the case of this embodiment, the second belt 502 is cooled by the heat sink 503. In order to efficiently cool the recording material S, the heat sink 503 is disposed so as to contact the inner peripheral surface of the second belt 502 at a place where the cooling nip T4 is formed. The recording material S is cooled through the second belt 502 when the recording material S passes through the cooling nip T4. For example, in the case where the temperature of the recording material S is about 90° C. before the recording material S passes through the recording material cooling device 50, the recording material S is cooled so that the temperature thereof becomes about 60° C. after the recording material S passes through the recording material cooling device 50. With cooling of this recording material S, the toner on the recording material S is cooled and fixed on the recording material S.

The heat sink 503 is radiator (dissipater) plate formed of metal such as aluminum. The heat sink 503 includes a heat receiving portion 503*a* for taking heat from the second belt 502 in contact with the second belt 502, a heat radiating (dissipating) portion 503*b* for radiating (dissipating) heat, and a fin base 503*c* for transferring the heat from the heat receiving portion 503*a* to the heat radiating portion 503*b*. The heat radiating portion 503*b* is formed with many heat radiating fins in order to promote efficient radiation by increasing a contact area to the air. For example, the heat radiating fins are set at 1 mm in thickness, 100 mm in height and 5 mm in pitch, and the fin base 503*c* is set at 10 mm in thickness. Further, in order to forcedly cool the heat sink 503 itself, a cooling fan 513 sending the air toward the heat sink 503 (specifically the heat radiating portion 503*b*) is provided. An air flow rate of the cooling fan 513 is set at, for example, 2 $m^3$/min. Incidentally, the cooling means for the heat sink 503 is not limited to the cooling for 513. Further, the cooling member is not limited to the heat sink 503, but the first belt 501 and the second belt 502 may also be cooled by using a belt cooling fan for blowing the air toward the associated belt or by using an air-cooling unit in which a pipe or the like in which a cooled liquid is circulated is contacted to the associated belt or by using the like means.

In such a recording material cooling device 50, an endless belt such as the second belt 502 or the first belt 501 is supported and rotated by the plurality of rollers, so that a meandering phenomenon such that the endless belt during rotation moves in the widthwise direction can occur. Therefore, one of the plurality of rollers for stretching each of the second belt 502 and the first belt 501 is tilted as a steering roller, and thus these second and first belts 502 and 501 are moved in the widthwise direction, so that the meandering phenomenon is suppressed. In order to do so, at one place of a rotation path of each of the second belt 502 and the first belt 501, a sensor portion 390 for detecting an end portion position of the associated belt is provided. On the basis of a detection signal of this sensor portion 390, the end portion position of each of the second belt 502 and the first belt 501 during rotation is detected. Then, on the basis of the detected end portion position, the above-described steering mechanism 400 is operated, so that the steering angle of the associated steering roller 502*b* or 501*b* is adjusted.

<Contact and Separation of Belt>

Figure 3:
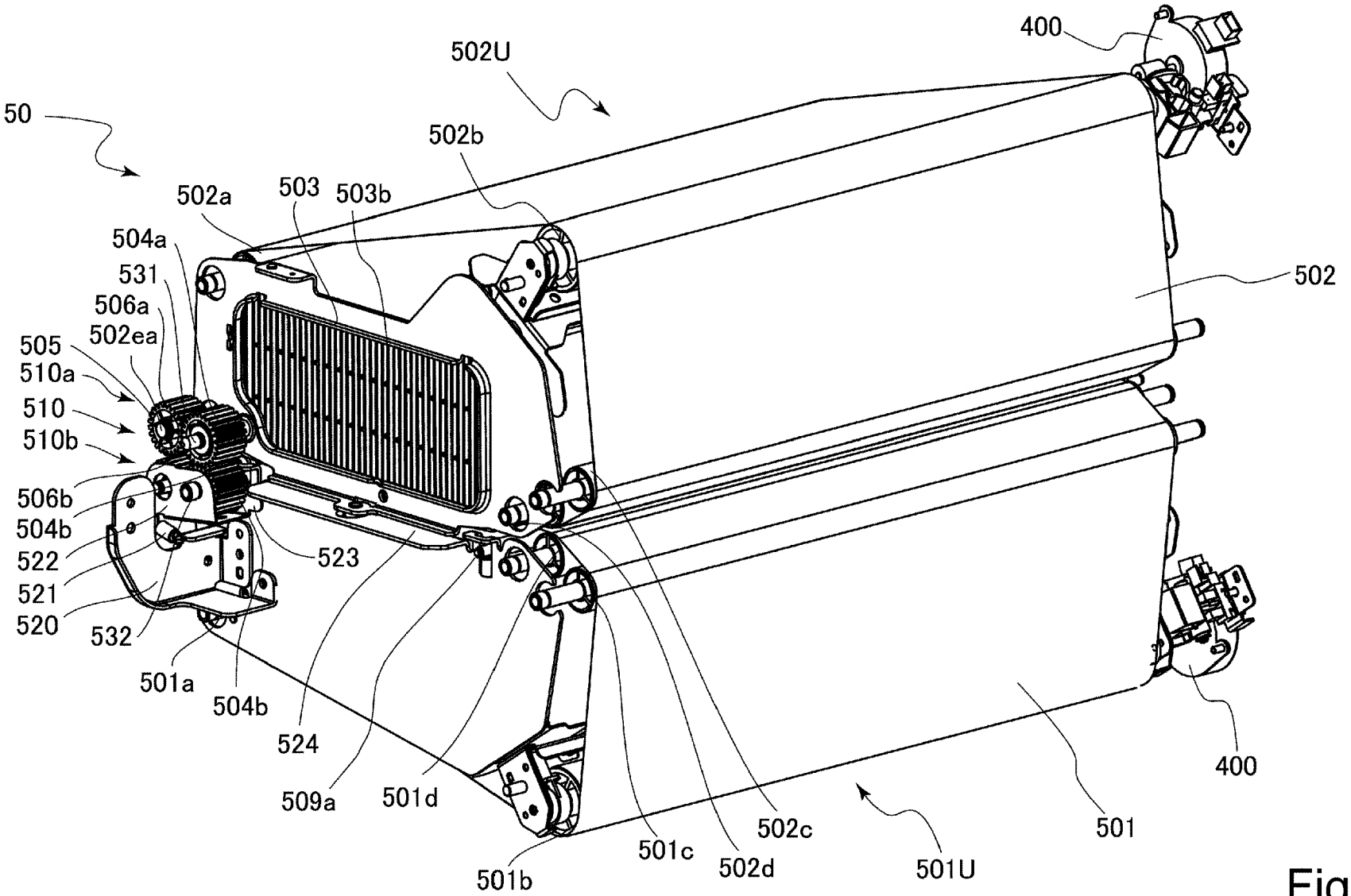
FIG. 3 is a perspective view showing a recording material cooling device in the case where a belt is in a contact position.
Figure 4:
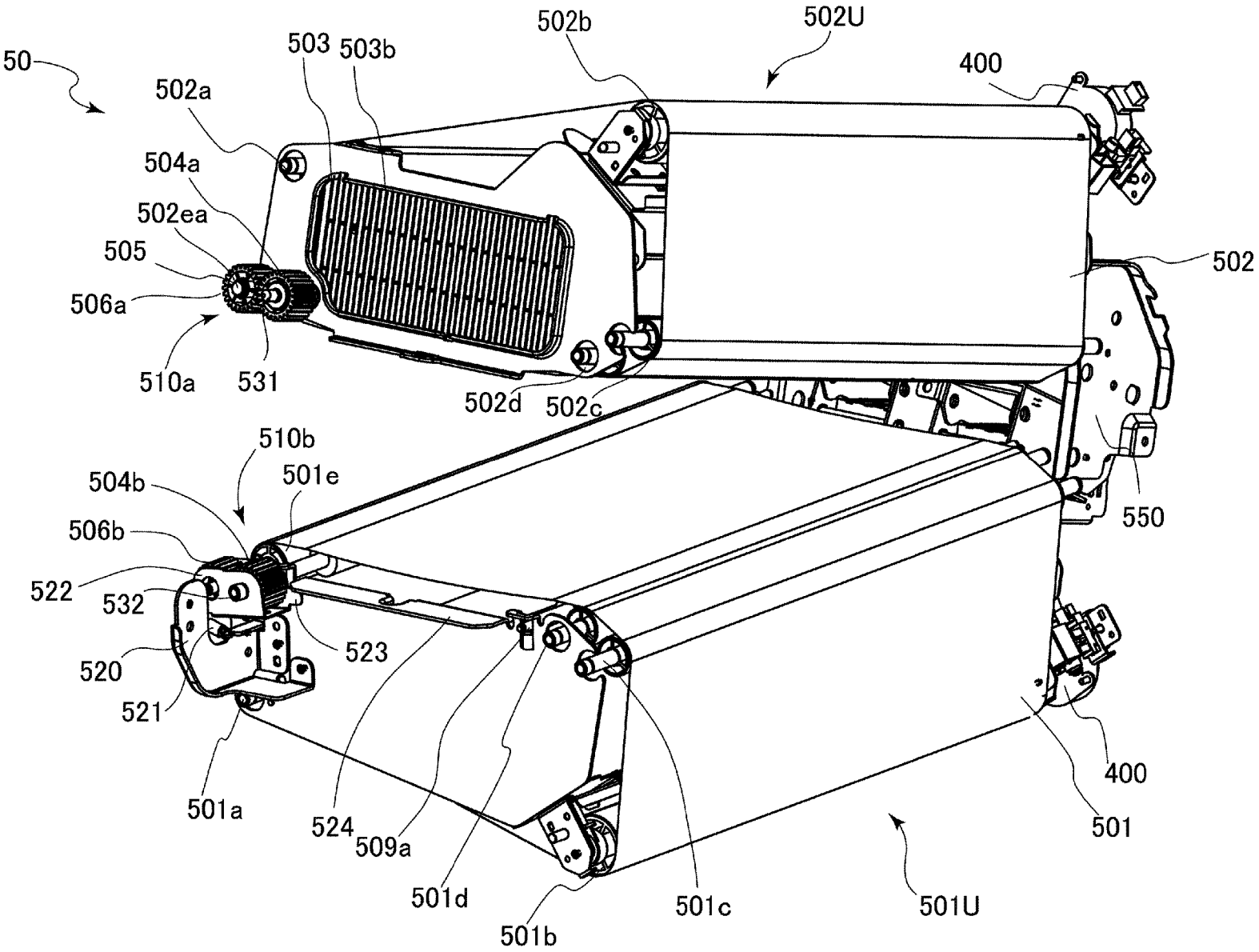
FIG. 4 is a perspective view of the recording material cooling device in the case where the belt is in a separated position.

As shown in FIGS. 2 to 4, the recording material cooling device 50 is roughly divided into a first unit 501U and the second unit 502U. The first unit 501U includes the first belt 501, the driving motor M, the first belt stretching rollers 501*a* to 501*e*, the first driving gear portion 510*b*, the pressing rollers 509*a* and 509*b*, the sensor portion 390 and the like. On the other hand, the second unit 502U includes the second belt 502, the second belt stretching rollers 502*a* to 502*e*, the second driving gear portion 510*a*, the heat sink 503, the sensor portion 390 and the like. Further, in the case of this embodiment, by a rotating mechanism 550, the second unit 502U is provided so as to be movable relative to the first unit 501U between a contact position where the second belt 502 and the surface belt 501 are in contact with each other and a separated position where the second belt 502 and the first belt 501 are in separation from each other. As described above, the driving motor M is provided to the first unit 501U immovable relative to the movable second unit 502U. Here, the immovable first unit 501U includes a constitution which does not move when the sheet nipped in the cooling nip T4 is removed and also includes somewhat backlash or a movable constitution during maintenance of the first unit 501U. Thus, the driving motor M is provided to the immovable first unit 501U, and therefore, it is possible to suppress that an unshown connecting line connecting the driving motor M and a control substrate or the like is nipped between the first unit 501U and the second unit 502U during the rotation of the unit.

The second unit 502U is provided so as to be rotatable relative to the first unit 501U about a rotation shaft (not shown) of the rotating mechanism 550 shown in FIG. 4. The second unit 502U is movable between the contact position where the second belt 502 and the first belt 501 are in contact with each other so as to form the cooling nip T4 and the separated position where the second belt 502 and the first belt 501 are in separation from each other so as not to form the cooling nip T4. FIG. 3 shows the case where the second unit 502U is in the contact position, and FIG. 4 shows the case where the second unit 502U is in the separated position. Incidentally, in this embodiment, a constitution in which a rotation center is provided on one end side of the second unit 502U with respect to the widthwise direction and in which entirety of the second unit 502U is movable relative to the first unit 501U by using a sliding mechanism or the like may also be employed. Further, an example in which the second unit 502U is rotated upward relative to the first unit 501U with respect to the direction of gravitation was shown, but the present invention is not limited thereto. One end side of the first unit 501U with respect to the widthwise direction may also be swung downward relative to the second unit 502U with respect to the direction of gravitation. In this case, a constitution in which the driving motor M is provided to the second unit 502U which is not rotated may only be required to be employed.

<Driving Gear Portion>

In this embodiment, rotation of the driving motor M for driving the first belt 501 is transmitted from the first belt stretching roller 501*e* to the second belt stretching roller 502*e* through the first driving gear portion 510, whereby the second belt 502 is rotated. As shown in FIGS. 3 and 4, the driving gear portion 510 is roughly divided into the second driving gear portion 510*a* provided on the second unit 502U and the first driving gear portion 510*b* provided on the first unit 501U. The driving gear portion 510 is separated into the second driving gear portion 510*a* and the first driving gear portion 510*b* in response to the swing of the second unit 502U, and is provided so as to be movable between a state in which a second transmission gear 504*a* and a first transmission gear 504*b* which are described later are engaged with each other and a state in which the second transmission gear 504*a* and the first transmission gear 504*b* are not engaged with each other. Thus, a constitution in which the driving motor M is provided on one end side (the same side as the side where the rotating mechanism 550 is provided) of a rotation shaft of the first belt stretching roller 501*e* and the driving gear portion 510 is provided on a side opposite from the driving motor M side and thus in which in the case where the second unit 502U is rotated about the rotating mechanism 550, engagement between the second driving gear portion 510*a* and the first driving gear portion 510*b* can be simply established and released is employed. Incidentally, when the constitution is capable of establishing and releasing the engagement between the second driving gear portion 510*a* and the first driving gear portion 510*b*, a constitution in which relative to the first belt stretching roller 502*e*, the second driving gear portion 510*a* and the first driving gear portion 510*b* are provided on the same one end side as the driving motor M side and thus drive is transmitted between the first unit 501U and the second unit 502U may also be employed. In the case of such a constitution, by employing a constitution in which the entirety of the second unit 502U is movable upward relative to the first unit 501U by using the sliding mechanism as described above, the engagement between the second driving gear portion 510*a* and the first driving gear portion 510*b* or release of this engagement can be satisfactorily carried out. Further, a constitution in which the driving motor M is provided on the other end side (the side opposite from the side where the rotating mechanism 550 is provided) of the rotation shaft of the first belt stretching roller 501*e* and in which the second driving gear portion 510*a* and the first driving gear portion 510*b* are provided on one end side of the rotation shaft of the first belt stretching roller 501*e* may also be employed, and a constitution in which all the driving motor M, the second driving gear portion 510*a* and the first driving gear portion 510*b* are provided on one end side of the rotation shaft of the first belt stretching roller 501*e* and in which drive is transmitted toward the first unit 501U and the second unit 502U may also be employed.

The second driving gear portion 510*a* includes a second gear 506*a* and the second transmission gear 504*a*. The second gear 506*a* is provided, rotatably through a one-way clutch 505, on a rotation shaft of the second belt stretching roller 501*e*. The second transmission gear 504*a* is provided, rotatably through a bearing (not shown), on a second idler shaft 531 fixed to a side plate of the second unit 502U. The second gear 506*a* and the second transmission gear 504*a* are always engaged with each other so as to transmit a driving force irrespective of swing of the first driving gear portion 510*b*. The one-way clutch 505 will be described later.

Figure 5:
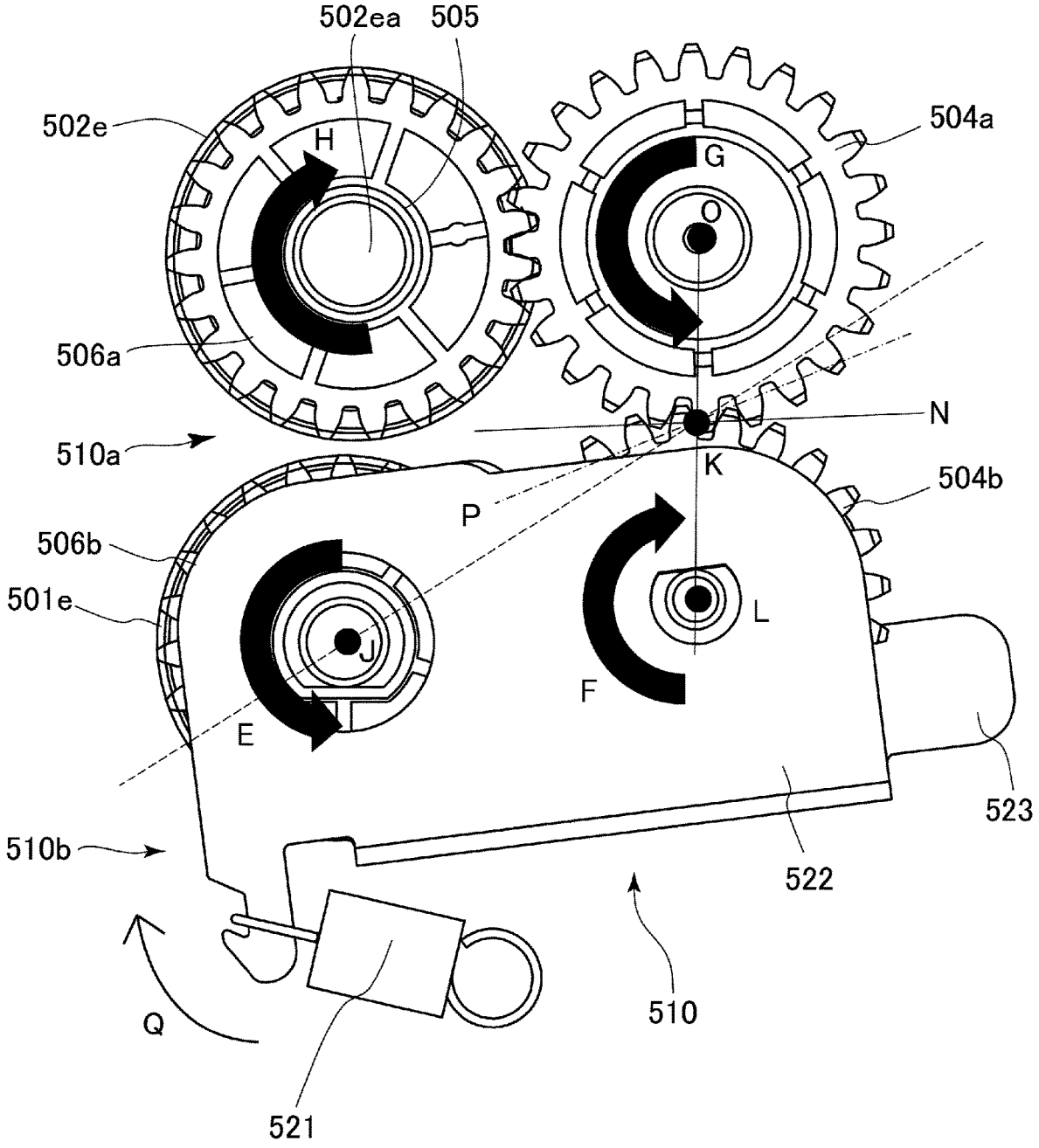
FIG. 5 is an enlarged view showing a driving gear portion.

The first driving gear portion 510*b* includes a first gear 506*b* and the first transmission gear 504*b*. A rotation shaft of the first belt stretching roller 501*e* includes a D-shaped end portion in cross-section, and the first gear 506*b* has a shape engageable with this D-shape and is not rotatable about the rotation shaft of the first belt stretching roller 501*e*. That is, the first gear 506*b* has a constitution in which the first gear 506*b* is rotatable integrally with the first belt stretching roller 501*e* and the rotation shaft thereof. A supporting member 522 is provided rotatably about the rotation shaft of the first belt stretching roller 501*e* through a bearing (not shown). By this, the supporting member 522 is rotatable about the rotation shaft of the first belt stretching roller 501*e*. The first transmission gear 504*b* is provided rotatably through a bearing (not shown) about an idler shaft 532 fixed to the supporting member 522. The supporting member 522 is urged so that the first transmission gear 504*b* moves toward the second transmission gear 504*a*, by a spring member 521 fixed at one end thereof to a fixing portion (not shown) provided on the side plate of the first unit 501U (FIG. 5). That is, the first driving gear portion 510*b* is provided swingably about a rotation shaft (which is also a rotation shaft of the first belt stretching roller 501*e*), as a swing center of the first gear 506*b*. The first gear 506*b* and the first transmission gear 504*b* are always engaged with each other so as to be capable of transmitting the driving force irrespective of the swing of the first driving gear portion 510*b*.

In this embodiment, all the second gear 506*a*, the second transmission gear 504*a*, the first gear 506*b* and the first transmission gear 504*b* which are described above are formed so as to provide the same module. However, these gears are constituted so that the number of teeth of the second transmission gear 504*a* and the first transmission gear 504*b* is more than the number of teeth of the second gear 506*a* and the first gear 506*b*. For example, the number of teeth of the second transmission gear 504*a* and the first transmission gear 504*b* is the same 24 teeth, and the number of teeth of the second gear 506*a* and the first gear 506*b* is the same 23 teeth. Thus, by making the numbers of teeth different from each other, a combination between the second gear 506*a* and the second transmission gear 504*a* which are always engaged with each other so as to be capable of transmitting the driving force and a combination between the first gear 506*b* and the first transmission gear 504*b* which are always engaged with each other so as to be capable of transmitting the driving force are prevented from engaging at the same place (position). Further, in this embodiment, all the second gear 506*a*, the second transmission gear 504*a*, the first gear 506*b* and the first transmission gear 504*b* are spur gears, so that engagement between the adjacent gears facilitated when the second unit 502U is moved relative to the first unit 501U from a separated state to a contact state.

As shown in FIG. 3, when the second belt 502 and the first belt 501 are in contact with each other and form the cooling nip T4, the second transmission gear 504*a* of the second driving gear portion 510*a* and the first transmission gear 504*b* of the first driving gear portion 510*b* engage with each other, so that a state in which a driving force is transmittable is formed. On the other hand, as shown in FIG. 4, when the second belt 502 and the first belt 501 are in non-contact with each other and do not form the cooling nip T4, the second transmission gear 504*a* and the first transmission gear 504*b* do not engage with each other, so that a state in which the driving force is not transmittable is formed.

As described above, in this embodiment, the first driving gear portion 510*b* is provided so as to be freely swingable about, as a swing center, a rotation shaft of the first gear 506*b*. Then, in the case where the second unit 502U is moved from the separated position (FIG. 4) to the contact position (FIG. 3), as shown in FIG. 5, the first driving gear portion 510*b* is moved clockwise against urging of the spring member 521 (arrow Q direction). This is because with movement of the second unit 502U, the second transmission gear 504*a* of the second driving gear portion 510*a* contacts and presses the first transmission gear 504*b* of the first driving gear portion 510*b*.

Further, in the case where the second unit 502U is moved from the contact position (FIG. 3) to the separated position (FIG. 4), the first driving gear portion 510*b* is moved counterclockwise by the urging of the spring member 521. Here, in the case where the first driving gear portion 510*b* is moved counterclockwise, a rotation restricting portion 523 formed on the supporting member 522 interferes with a projected portion 524 (FIGS. 3 and 4) provided on the side plate of the first unit 501U, so that rotation of the first driving gear portion 510*b* is restricted. By doing so, the first driving gear portion 510*b* and the second driving gear portion 510*a* are caused to be at rest at a predetermined angle. In the case of this embodiment, this predetermined angle is not so that in the case where the second unit 502U is moved from the separated position to the contact position, the second transmission gear 504*a* and the first transmission gear 504*b* engage with each other and thus are capable of transmitting the driving force therebetween. In addition, each of the second driving gear portion 510*a* and the first driving gear portion 510*b* is disposed so that when the first belt 501 is rotated by the driving motor M (FIG. 2), the first transmission gear 504*a* is rotated in a state in which the first transmission gear 504*b* is always urged against the second transmission gear 504*a*.

Arrangement of the second driving gear portion 510*a* and the first driving gear portion 510*b* will be specifically described. As shown in FIG. 5, a rectilinear line connecting a rotation center O of the second transmission gear 504*a* and a rotation center L of the first transmission gear 504*b* is referred to as a rectilinear line OL. Further, a contact point where a pitch circle of the second transmission gear 504*a* and a pitch circle of the first transmission gear 504*b* contact each other in a state (state in which drive transmission is enabled) in which a free end (top) of the tooth of the second transmission gear 504*a* and a free end (top) of the tooth of the first transmission gear 504*b* contact each other is referred to as a point K. Further, a rectilinear line connecting this point K and a swing center J of the first driving gear portion 510*b* is referred to as a rectilinear line JK. Further, a rectilinear line perpendicular to a rectilinear line LK passing through the rotation center L and the point K is referred to as a line segment KN. The line segment KN is a tangential line between the second transmission gear 504*a* and the first transmission gear 504*b*. The second transmission gear 504*a* and the first transmission gear 504*a* are capable of transmitting the driving force to each other. This transmission of the driving force acts in a line segment direction in which a pressure angle is added to the line segment KN. In this embodiment, the pressure angle was set at 20°.

A direction in which the transmission of the driving force by the second transmission gear 504*a* and the first transmission gear 504*b* is carried out is represented by a line segment SK inclined relative to the line segment KN by the above-described pressure angle. The rectilinear line JK and the line segment PK which are shown in FIG. 5 are compared with each other. In the case of this embodiment, the line segment PK representing the driving force transmission direction by the second transmission gear 504*a* and the first transmission gear 504*b* is positioned on a side upstream of the rectilinear line JK with respect to a rotational direction (arrow G direction) of the second transmission gear 504*a* and is in a position where the first transmission gear 504*b* bites into the second transmission gear 504*a* side than in the case of the rectilinear line JK. By doing so, when the first belt 501 is rotated by the driving motor M, the first transmission gear 504*b* is capable of operating so as to bite into the second transmission gear 504*b* by forces generated by the second transmission gear 504*a* and the first transmission gear 504*b*.

Further, in the case where the second unit 502U is moved from the separated position to the contact position and where the first transmission gear 504*b* and the second transmission gear 504*a* do not engage with each other, tooth tops of the respective gears contact each other, and therefore, the rectilinear line OL becomes longer than the rectilinear line OL when the second unit 502U is in the contact position. Further, when the second unit 502U is in the contact position shown in FIG. 3 and the driving motor M does not rotate the first belt 501, the first transmission gear 504*b* is kept in a state in which the first transmission gear 504*b* is contacted to the first transmission gear 504*a* by the spring member 521 as an urging means. Then, when the first belt 501 is rotated by the driving motor M, the first driving gear portion 510*b* is rotated clockwise, so that the second transmission gear 504*a* and the first transmission gear 504*b*.

That is, when with movement of the second unit 502U from the separated position to the contact position, a tooth top of the second transmission gear 504*a* abuts against a tooth top of the first transmission gear 504*b*, the first driving gear portion 510*b* moves against an urging force of the spring member 521 while keeping the abutment state between the tooth tops. After the movement of the second unit 502U to the contact position, when the first belt stretching roller 501*e* is rotated (in an arrow E direction) by the driving motor M in a state in which the tooth tops are in contact with each other, the first transmission gear 504*b* is rotated clockwise (in an arrow F direction) through transmission of the driving force thereto. When the first transmission gear 504*b* is rotated, a contact position between the tooth of the first transmission gear 504*b* and the associated tooth of the second transmission gear 504*a* which abut against each other is deviated. When the contact position is deviated, by the urging force of the spring member 521, the first driving gear portion 510*b* is moved toward the second driving gear portion 510*a*. By this, the first transmission gear 504*b* and the second transmission gear 504*a* engage with each other. In order to realize such engagement, the second driving gear portion 510*a* and the first driving gear portion 510*b* are provided as described above.

Figure 6:
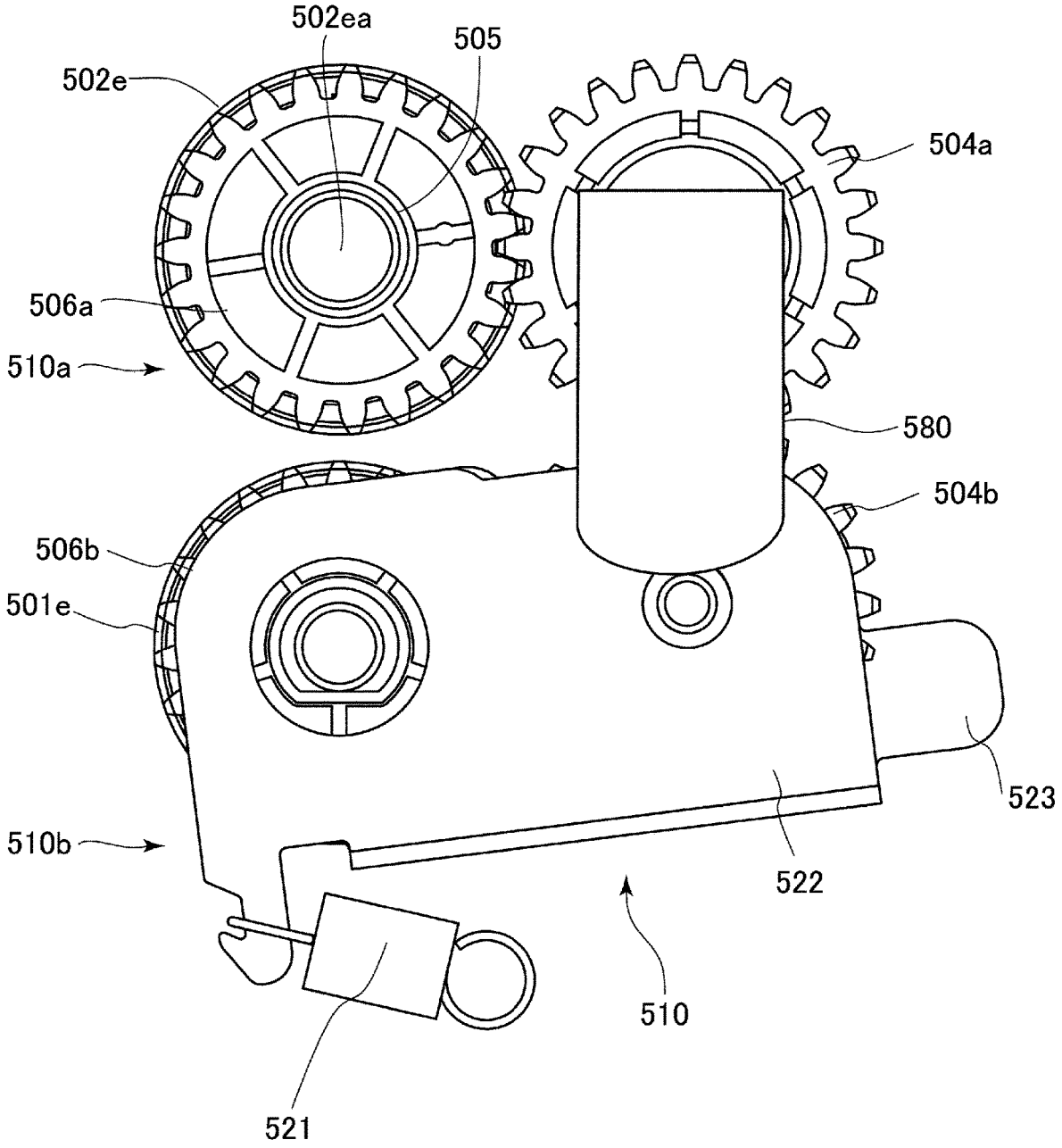
FIG. 6 is an enlarged view showing an inter-axis (shaft) restricting member.

Further, as in this embodiment, in the case where the first driving gear portion 510*b* is made swingable, in a state in which the first transmission gear 504*b* and the second transmission gear 504*a* engage with each other, transmission of the driving force from the first transmission gear 504*b* to the second transmission gear 504*a* is liable to be impaired. This is because the first driving gear portion 510*b* is urged toward the second transmission gear 504*a* by the spring member 521 and thus the first transmission gear 504*b* and the second transmission gear 504*a* are strongly engaged with each other by the urging force of the spring member 521. In view of this, in this embodiment, by ensuring a center distance between the second transmission gear 504*a* and the first driving gear portion 510*b*, the first transmission gear 504*b* and the second transmission gear 504*a* are engaged with each other by a force suitable for drive transmission without being influenced by the urging force of the spring member 521. Specifically, as shown in FIG. 6, an inter-axis (center distance) restricting member 580 is provided, so that the center distance between the second transmission gear 504*a* and the first transmission gear 504*b* is ensured. In FIGS. 2 to 5, the inter-axis restricting member 580 is omitted from illustration. The inter-axis restricting member 580 is provided on the rotation shaft of the second transmission gear 504*a* in the second unit 502U and contacts the rotation shaft of the first transmission gear 504*b* when the second unit 502U is in the contact position. The inter-axis restricting member 580 is formed in an arcuate shape at a portion thereof contacting the rotation shaft of the first transmission gear 504*b*. By this, when the inter-axis restricting member 580 contacts the rotation shaft of the first transmission gear 504*b*, even if an abutment position is somewhat deviated with respect to the feeding direction (the arrow D direction of FIG. 2) of the recording material S, the center distance between the second transmission gear 504*a* and the first driving gear portion 510*b* can be ensured.

As described above, in this embodiment, in the case where the second unit 502U is moved from the separated position to the contact position, the second transmission gear 504*a* of the second driving gear portion 510*a* contacts the first transmission gear 504*b* of the first driving gear portion 510*b*, so that the first driving gear portion 510*b* swings. That is, even when the tooth of the second transmission gear 504*a* and the tooth of the first transmission gear 504*b* abut against each other during the movement of the second unit 503U to the contact position, the first driving gear portion 510 moves so as to avoid the abutment, so that breakage between the tooth of the second transmission gear 504*a* and the tooth of the first transmission gear 504*b* does not readily occur. Further, when the second unit 502U is moved to the contact position, even if the tooth of the second transmission gear 504 and the tooth of the first transmission gear 504*b* do not engage with each other, these teeth engage with each other with subsequent rotation of the first belt stretching roller 501*e*. Also, at that time, it is possible to suppress that an excessive force is exerted on these teeth, so that these teeth are not readily broken.

<One-Way Clutch>

In order to cool the recording material S in the cooling nip T4, in the case where the recording material S is nipped and fed by the second belt 502 and the first belt 501, it is desirable that a moving speed of the second belt 502 and a moving speed of the first belt 501 are made substantially equal to each other for stabilizing feeding of the recording material S. In the case of this embodiment, the moving speed of the first belt 501 rotated by the first belt stretching roller 501*e* directly driven by the driving motor M is a base (reference) speed. For this reason, it is desirable to employ a constitution in which the moving speed of the second belt 502 rotates by the second belt stretching roller 502*e* to which drive of the driving motor M is indirectly transmitted through the driving gear portion 510 is equal to the moving speed of the first belt 501.

However, in a conventional constitution, the moving separated position of the second belt 502 and the moving speed of the first belt 501 do not coincide with each other in some instances. For example, in the case where a diameter of the second belt stretching roller 502*e* is formed so as to be smaller than a diameter of the first belt stretching roller 501*e* due to processing accuracy or in the like case, the moving speed of the second belt 502 is liable to be higher than the moving speed of the first belt 501. Thus, in the case where the moving speed of the second belt becomes high due to a variation in diameter of the second belt stretching roller 502*e* or the like, with a longer rotation time of the second belt 502, the moving speed of the second belt 502 becomes higher, so that a difference in moving speed between itself and the moving speed of the first belt 501 can become large. In that case, feeding of the recording material S nipped and fed by the second belt 502 and the first belt 501 becomes unstable and is not preferred. Further, in the case of a constitution in which the first driving gear portion 510*b* is urged toward the second transmission gear 504*a* by the urging force of the spring member 521 as described above, when the moving speed of the second belt 502 becomes higher than the moving speed of the first belt 501, a rotational speed of the second transmission gear 504*a* becomes higher than a rotational speed of the first transmission gear 504*b*. Then, the first transmission gear 504*b* rotated by the driving force of the driving motor M is repelled by the second transmission gear 504*a*, so that engagement between the second transmission gear 504*a* and the first transmission gear 504*b* is released against the urging force of the spring member 521. Although the second transmission gear 504*a* and the first transmission gear 504*b* which are disengaged from each other are capable of engaging with each other again by the urging force of the spring member 521, the release of the engagement between the transmission gears frequently occurs by repelling of the first transmission gear 504*b* as long as a rotational speed difference between the second transmission gear 504*a* and the first transmission gear 504*b* (between the second belt 502 and the first belt 501) occurs. In this case, the driving force of the driving motor M is not transmitted to the second belt 502, and interrupting action acts on the second belt 502 relative to the first belt 501 to which the driving force of the driving motor M is continuously transmitted, so that there was a liability that improper sheet feeding or the like occurs.

In this embodiment, in order to suppress the occurrence of the difference in moving speed between the second belt 502 and the first belt 501, the driving gear portion 510 is provided with a one-way clutch 505. In the case where the speed difference occurs between the second belt 502 and the first belt 501, transmission and interruption of the drive by the one-way clutch is automatically switched, whereby the speed difference between the second belt 502 and the first belt 501 can be made small. In the following, the driving gear portion 501 provided with the one-way clutch will be described using FIG. 7 while making reference to FIGS. 2, 3 and 5.

Figure 7:
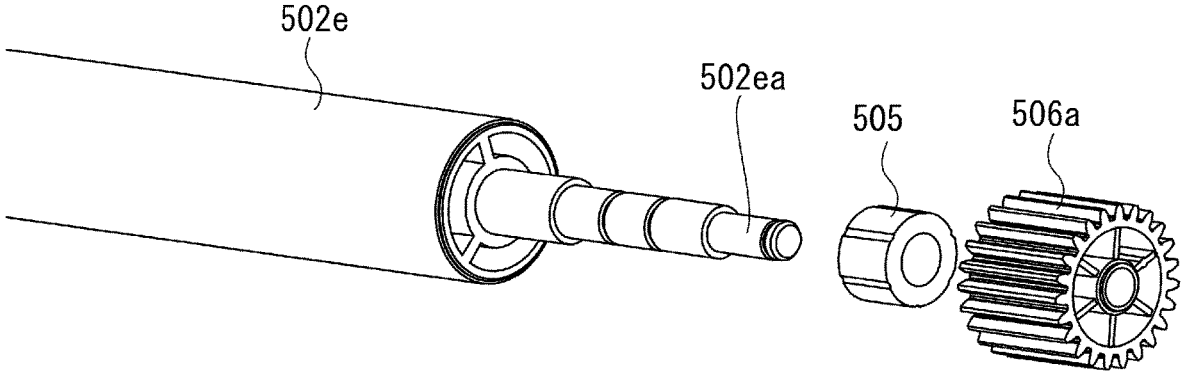
FIG. 7 is an exploded perspective view showing a one-way clutch.

As shown in FIG. 5, in the case of this embodiment, the one-way clutch 505 as a drive switching portion is provided inside the second gear 506*a* so that a rotation center of the second gear 506*a* and a rotation center of the one-way clutch 505 coincide with each other. Specifically, as shown in FIG. 7, the one-way clutch 505 is mounted integrally with the second gear 506*a* and rotatably on a rotation shaft 502*ea*, which is a rotation center, of the second belt stretching roller 502*e* in a state in which the one-way clutch 505 is press-fitted in the second gear 506*a*. That is, the second gear 506*a* is shaft-supported by the rotation shaft 502*ea* via the one-way clutch 505. The one-way clutch 505 is rotated integrally with the rotation shaft 502*a* in the case where the second gear 506*a* is rotated clockwise (in an arrow H direction) in FIG. 5 and permits drive transmission to the second belt stretching roller 502*e*. In the case where the second gear 506*a* is rotated counterclockwise (in a direction opposite to the arrow H direction) in FIG. 5, the one-way clutch 505 is idled relative to the rotation shaft 502*ea*, and therefore, the drive transmission from the second gear 506*a* to the second belt stretching roller 502*e* is interrupted.

For example, in the case where the drive of the driving motor M (FIG. 2) is started for rotating the first belt 501, rotation of the first gear 506*b* of the first driving gear portion 510*b* is started counterclockwise (in the arrow E direction), so that the first transmission gear 504*b* is rotated clockwise (in the arrow F direction). Then, the second transmission gear 504*a* of the second driving gear portion 510*a* to which the drive (driving force) is transmitted is rotated counterclockwise (in an arrow G direction), so that the second gear 506*a* is rotated clockwise (in the arrow H direction).

When the second gear 506*a* is rotated clockwise, the second gear 506*a* and the rotation shaft of the second belt stretching roller 502*e* are put in a drive transmission state, so that the second belt stretching roller 502*e* is rotated clockwise. Thus, by rotating the second belt stretching roller 502*e* clockwise, the second belt 502 is rotated clockwise (in the arrow B direction in FIG. 2). At this time, the number of rotations (turns) of the second gear 506*a* and the number of rotations of the second belt stretching roller 502*e* are the same. Then, in response to an increase in the number of rotations to a predetermined number of rotations, the moving speed of the second belt 502 and the moving speed of the first belt 501 are also increased. Here, when the diameter of the second belt stretching roller 502*e* and the diameter of the first belt stretching roller 501*e* are the same, the moving speeds of the second belt 502 and the first belt 501 are the same. However, as described above, for example, when the diameter of the second belt stretching roller 502*e* is larger than the diameter of the first belt stretching roller 501*e*, the moving speed difference between the second belt 502 and the first belt 501 can occur.

As in this embodiment, by providing the driving gear portion 510 with the one-way clutch 505, it is possible to suppress the moving speed difference between the second belt 502 and the first belt 501. Here, in the case where the second belt stretching roller 502*e* and the second gear 506*a* are moved in opposite directions relative to each other, the one-way clutch 505 does not permit transmission of the driving force by the second gear 506*a* to the rotation shaft 502*ea* of the second belt stretching roller 502*e*. That is, when the moving speed of the second belt 502 becomes higher than the moving speed of the first belt 501, by the one-way clutch 505, the second gear 506*a* and the rotation shaft 502*ea* of the second belt stretching roller 502*e* are put in a drive interruption state. In that case, the second belt stretching roller 502*e* is freely rotated (idled) relative to the second gear 506*a*. That is, irrespective of the drive transmission by the driving gear portion 510, the second belt stretching roller 502*e* and by extension to the second belt 502 are rotated.

Thus, by providing the one-way clutch, in the case where the moving speed of the second belt 502 becomes higher than the moving speed of the first belt 501, the second gear 506*a* is rotated by receiving the driving force of the driving motor M through the first driving gear portion 510*b*, but the second belt stretching roller 502*e* is rotated by receiving the rotation (rotational force) of the second belt 502. In this case, the second belt 502 is only rotated by the first belt 501 contacted thereto in the cooling nip T4, and the driving force of the driving motor M is not applied to the second belt 502. Accordingly, the moving speed of the second belt 502 follows the moving speed of the first belt 501 and thus gradually decreases so as to be equal to the moving speed of the first belt 501.

As described above, the moving speed of the second belt 502 follows the moving speed of the first belt 501, so that a peripheral speed of the second belt stretching roller 502*e* lowers to a speed not more than a peripheral speed of the second gear 506*a* driven by the driving motor M. Then, by the one-way clutch 505, the second gear 506*a* and the rotation shaft of the second belt stretching roller 502*e* are put in the drive transmission state again. When the second gear 506*a* and the rotation shaft of the second belt stretching roller 502*e* are put in the drive transmission state by the one-way clutch 505, the driving force is transmitted to the second belt stretching roller 502*e* by the driving gear portion 510, so that the second belt stretching roller 502*e* is rotated by the driving force. Then, when the moving speed of the second belt 502 becomes higher than the moving speed of the first belt 501 again, as described above, the drive interruption state is formed by the one-way clutch 505.

Thus, the one-way clutch 505 is provided so as to be capable of changing the transmission and the interruption of the drive to each other between the second gear 506*a* and the rotation shaft of the second belt stretching roller 502*e*. Then, in the case where the moving speed difference between the second belt 502 and the first belt 501 occurs, by the one-way clutch, transmission and non-transmission of the driving force between the second gear 506*a* and the rotation shaft of the second belt stretching roller 502*e* are repeated. By this, it is possible to suppress the occurrence of the moving speed difference between the second belt 502 and the first belt 501.

OTHER EMBODIMENTS

Figure 8:
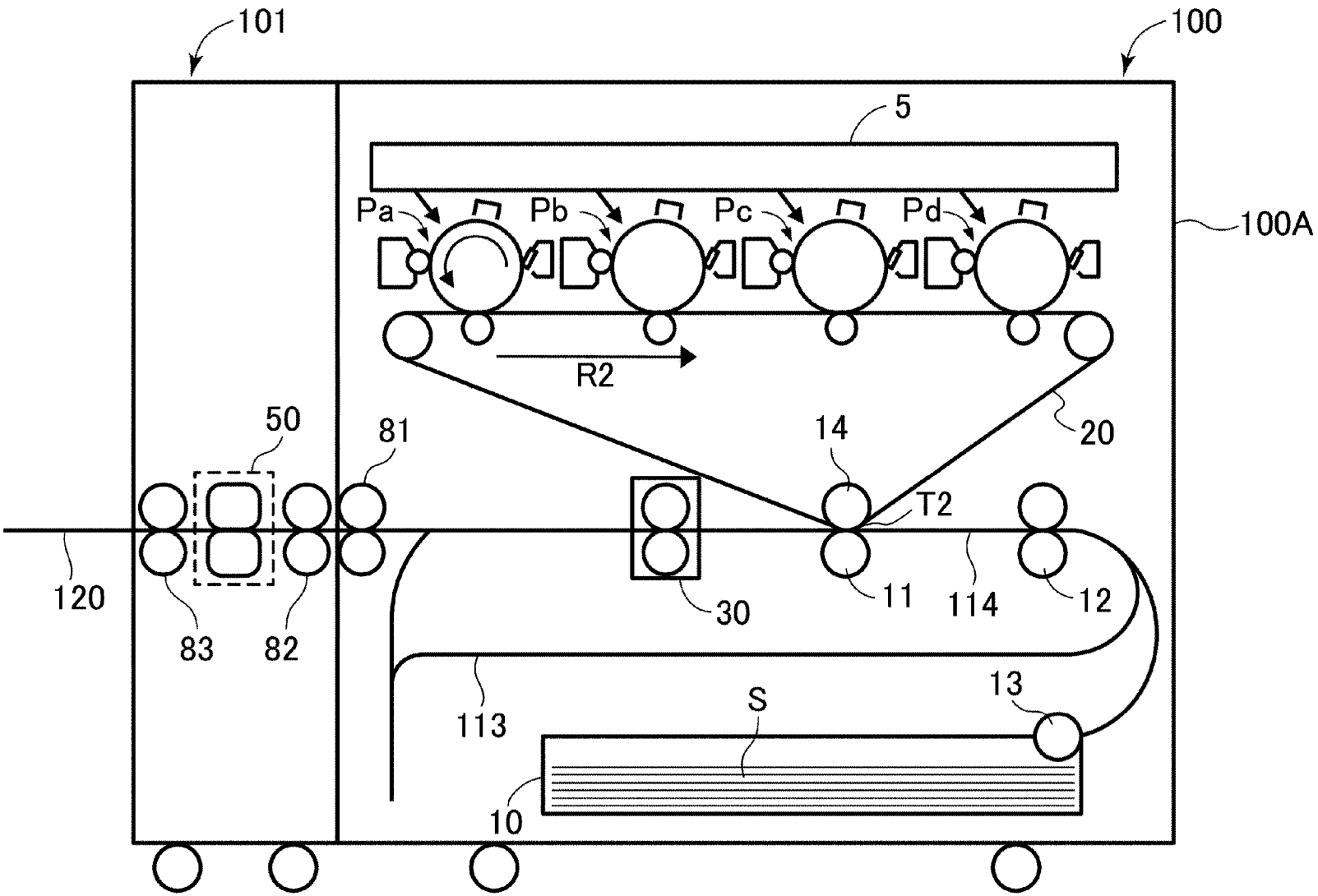
FIG. 8 is a schematic view showing an example in which the recording material cooling device is provided outside an outside of the image forming apparatus.

In the above-described embodiment, the case where the recording material cooling device 50 was provided in the apparatus main assembly 100A of the image forming apparatus 100 was described as an example (FIG. 1), but the present invention is not limited thereto. For example, the recording material cooling device 50 may also be provided outside the apparatus main assembly 100A. FIG. 8 shows an example in which the recording material cooling device 50 is provided outside the apparatus main assembly 100A.

As shown in FIG. 8, to the apparatus main assembly 100A, an external cooling device 101 is connected. The external cooling device 101 is constituted as one of peripheral devices (called option units or the like) capable of being retrofitted to the apparatus main assembly 100A in order to extend the function of the image forming apparatus 100, so as to be connectable to the image forming apparatus 100. The external cooling device 101 is provided for lowering a temperature of the recording material S, high compared with the temperature before fixing, to a predetermined temperature by cooling the recording material S discharged through a discharge opening. The external cooling device 101 includes the above-described recording material cooling device 50 for cooling the recording material S. In this embodiment, in the case where the external cooling device 101 is connected as an external device to the image forming apparatus 100 as shown in FIG. 8, the image forming apparatus 100 and the external cooling device 101 are inclusively referred to as an image forming apparatus. That is, in this embodiment, an entire apparatus relating to operations from feeding of the sheet on which the image is to be formed to discharge of the sheet to an outside of the image forming apparatus is referred to as the image forming apparatus. Further, in the case where on a side downstream of the external cooling device 101, a sheet processing device for subjecting the sheets to a binding process, a punching process or the like is connected to the external cooling device 101, all the constitutions including the external cooling device 101 and the sheet processing device are inclusively referred to as an image forming apparatus for forming the image on the sheet.

The recording material S cooled by the external cooling device 101 is discharged from the external cooling device 101 by a discharging roller pair 83 and is stacked on the sheet discharge tray 120. The sheet discharge tray 120 is provided so as to be mountable to and dismountable from the external cooling device 101 or the image forming apparatus 100. That is, in the case where the external cooling device 101 is not connected to the image forming apparatus 100, the sheet discharge tray 120 is mounted to the image forming apparatus 100 (FIG. 1). Further, when the external cooling device 101 is connected to the image forming apparatus 100, the sheet discharge tray 120 is dismounted from the image forming apparatus 100 and then is mounted to the external cooling device 101.

Incidentally, as the peripheral machine, a plurality of external cooling devices 101 may also be connected. By increasing the number of external cooling devices 101 to be connected, the operator is capable of easily improving cooling power of the recording material S in the already-installed image forming apparatus 100.

Incidentally, as in the above-described embodiments, the present invention is not limited to the image forming apparatus applied to the recording material cooling device 50, but may also be applied to a sheet feeding device, a fixing device, or the like of a belt type in which the recording material S is nipped and fed by a pair of belts. That is, in the case of a constitution in which the recording material S is nipped and fed through a nip formed by the pair of belts contacting each other, the present invention is applied, so that it is possible to suppress that a moving speed of one of the belts becomes higher than a peripheral speed of a driving gear. By this, there is no occurrence of abrasion of toner on the nip-fed recording material S and creases on the recording material S due to the belt moving speed difference.

Incidentally, in the above-described embodiments, a constitution in which drive transmission between the first belt stretching roller 501*e* and the second belt stretching roller 502*e* can be established through the first transmission gear 504*b* and the second transmission gear 504*a* was described, but the present invention is not limited thereto. For example, the drive transmission may also be established by direct engagement between the first belt stretching roller 501*e* and the second belt stretching roller 502*e* or through a larger number of transmission gears. Incidentally, in the case of the constitution in which the first belt stretching roller 501*e* and the second belt stretching roller 502*e* are directly engaged with each other, it is preferable that a tooth top of the first gear 506*b* and a tooth top of the second gear 506*a* are sharpened and thus are easily engaged with each other.

Incidentally, in the above-described embodiments, the constitution in which the one-way clutch 505 in provided as the drive switching portion was described, but a similar effect can be obtained even in a constitution in which as the drive switching portion, a torque limiter, an electromagnetic clutch, or the like is provided. Further, in the above-described embodiment, the constitution in which the one-way clutch 505 is provided on the rotation shaft of the second belt stretching roller 502*e* was described, but may only be required to be provided on a gear shaft of either one of the second driving gear portion 510*a* and the first driving gear portion 510*b* which constitute a drive transmission passage. For example, the first idler shaft 532 of the first transmission gear 504*b* is used as a shaft rotatable relative to the supporting member 522, and the one-way clutch 505 may also be provided between this shaft and the first transmission gear 504*b*. Further, a similar constitution may also be provided for the second idler shaft 531 to of the second transmission gear 504*a*.

According to the present invention, it is possible to provide the image forming apparatus including the cooling device capable of driving the pair of belt units by the single motor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2020-086682 filed on May 18, 2020, 2020-086683 filed on May 18, 2020, and 2021-064781 filed on Apr. 6, 2021, which are hereby incorporated by reference herein in their entirety.

What is claimed is:

1. An image forming apparatus comprising:

a fixing device configured to fix a toner image on a sheet by heating the sheet; and a cooling device provided on a side downstream of the fixing device with respect to a sheet feeding direction, the cooling device comprising:

a first unit including a first belt and a first roller configured to support and rotate the first belt;

a second unit including a second belt configured to form a nip in which the sheet is nipped and fed in cooperation with the first belt, a heat sink contacting an inner peripheral surface of the second belt, and a second roller configured to support and rotate the second belt, wherein the second unit is movable between a contact position where the first belt and the second belt are in contact with each other so as to form the nip and a separated position where the first belt and the second belt are separated from each other so as to release the nip;

a driving motor configured to rotate the first roller and the second roller; and a drive transmission portion including at least four gears, the drive transmission portion being configured to transmit a rotational driving force of the driving motor to the first roller and the second roller by rotation of the gears;

wherein the drive transmission portion includes:

a first driving gear portion provided on the first unit and including a first gear to which the rotational driving force is transmitted from the driving motor and a first transmission gear as a last gear provided on the first unit in a driving force transmission passage of the gears; and a second driving gear portion provided on the second unit and including a second transmission gear to which the rotational driving force is transmitted from the first transmission gear by engagement with the first transmission gear;

an urging portion configured to urge the first driving gear portion so that the first transmission gear moves toward the second transmission gear, and wherein, in a case where the second unit moves from the separated position to the contact position, the first driving gear portion is movable against an urging force of the urging portion by pressing of the first transmission gear by the second transmission gear.

2. An image forming apparatus according to claim 1, wherein the second unit is rotatable relative to the first unit about a rotation shaft extending along the sheet feeding direction of the cooling device, and wherein, with respect to a rotational axis direction of the first roller, the driving motor is provided on the same side as a side where a rotation center of the second unit is provided.

3. A image forming apparatus according to claim 1, wherein the second unit is rotatable relative to the first unit about a rotation shaft extending along the sheet feeding direction of the cooling device, wherein, with respect to a rotational axis direction of the first roller, the driving motor is provided on the same side as a side where a rotation center of the second roller is provided, and rotates the first roller, and wherein with respect to the rotational axis direction of the first roller, the drive transmission portion is provided to on a side opposite from a side where the driving motor is provided.

4. An image forming apparatus according to claim 1, wherein in a case that the first transmission gear and the second transmission gear are not in engagement with each other in a state in which the second unit is moved to the contact position, the first driving gear portion moves so that the first transmission gear is rotated and engaged with the second transmission gear by rotation of the first roller.

5. An image forming apparatus according to claim 4, wherein the first driving gear portion is provided so as to be swingable about a rotation center of the first gear, and wherein the first driving gear portion and the second driving gear portion are provided so that a rectilinear line inclined from a tangential line between a pitch circle of the first transmission gear and a pitch circle of the second transmission gear by a pressure angle of the first transmission gear passes through a second transmission gear side that a rectilinear line connecting a rotation center of the first gear and a contact point between the pitch circle of the first transmission gear and the pitch circle of the second transmission gear passes through.

6. An image forming apparatus according to claim 1, wherein the second driving gear portion includes a restricting member configured to restrict a center distance between the first transmission gear and the second transmission gear in a case that the second unit is moved to the contact position.

7. An image forming apparatus according to claim 1, wherein the second driving gear portion includes a second gear configured to transmit the rotational driving force, which is the rotational driving force transmitted from the second transmission gear, to the second roller;

wherein the number of teeth of the first gear and the number of teeth of the second gear are the same, and wherein the number of teeth of the first transmission gear and the number of teeth of the second transmission gear are the same and are more than the number of teeth of the first gear and the number of teeth of the second gear.

8. An image forming apparatus according to claim 7, further comprising a drive switching portion configured to switch drive of the second roller so that a driving force of the first driving gear portion is not transmitted to the second driving gear portion in a case that a peripheral speed of the second roller is greater than a peripheral speed of the second gear and so that the driving force of the first driving gear portion is transmitted to the second driving gear portion in a case that the peripheral speed of the second roller is not more than the peripheral speed of the second gear.

9. An image forming apparatus according to claim 8, wherein the drive switching portion is a one way clutch configured to interrupt drive transmission to the second roller by the second gear in a case that the second roller and the second gear are rotated in opposite directions to each other.

10. An image forming apparatus according to claim 1, wherein the first driving gear portion includes a supporting portion configured to rotatably support a rotational axis of the first gear and a rotational axis of the first transmission gear, and the first driving gear is swingable by urging of the urging portion, and wherein a restricting portion configured to restrict swinging of the supporting portion by urging of the urging portion in a state which the second unit is positioned at the separated position.

11. A sheet feeding apparatus comprising:

a first unit including a first belt and a first roller configured to support and rotate the first belt;

a second unit including a second belt configured to form a nip in which a sheet is nipped and fed in cooperation with the first belt, a heat sink contacting an inner peripheral surface of the second belt, and a second roller configured to support and rotate the second belt, wherein the second unit is movable between a contact position where the first belt and the second belt are in contact with each other so as to form the nip and a separated position where the first belt and the second belt are separated from each other so as to release the nip;

a driving motor configured to rotate the first roller and the second roller; and a drive transmission portion including at least four gears, the drive transmission portion being configured to transmit a rotational driving force of the driving motor to the first roller and the second roller by rotation of the gears;

wherein the drive transmission portion includes:

a first driving gear portion provided on the first unit and including a first gear to which the rotational driving force is transmitted from the driving motor and a first transmission gear as a last gear provided on the first unit in a driving force transmission passage of the gears; and a second driving gear portion provided on the second unit and including a second transmission gear to which the rotational driving force is transmitted from the first transmission gear by engagement with the first transmission gear;

an urging portion configured to urge the first driving gear portion so that the first transmission gear moves toward the second transmission gear, and wherein, in a case the second unit moves from the separated position to the contact position, the first driving gear portion is movable against an urging force of the urging portion by pressing of the first transmission gear by the second transmission gear.

12. A sheet feeding apparatus according to claim 11, wherein the second unit is rotatable relative to the first unit about a rotation shaft extending along a sheet feeding direction of the sheet feeding apparatus, wherein, with respect to a rotational axis direction of the first roller, the driving motor is provided on the same side as a side where a rotation center of the second roller is provided, and the driving motor rotates the first roller, and wherein, with respect to the rotational axis direction of the first roller, the drive transmission portion is provided on a side opposite from a side where the driving motor is provided.

13. An image forming apparatus according to claim 11 wherein the second driving gear portion includes a restricting member configured to restrict a center distance between the first transmission gear and the second transmission gear in a case that the second unit is moved to the contact position.

14. An image forming apparatus according to claim 11, wherein second driving gear portion includes a second gear configured to transmit the rotational driving force, which is the rotational driving force is transmitted from the second transmission gear, to the second roller, wherein the number of teeth of the first gear and the number of teeth of the second gear are the same, and wherein the number of teeth of the first transmission gear and the number of teeth of the second transmission gear are the same and are more than the number of teeth of the first gear and the number of teeth of the second gear.

15. An image forming apparatus according to claim 14, further comprising a drive switching portion configured to switch drive of the second roller so that a driving force of the first driving gear portion is not transmitted to the second driving gear portion in a case that a peripheral speed of the second roller is greater than a peripheral speed of the second gear and so that the driving force of the first driving gear portion is transmitted to the second driving gear portion in a case that the peripheral speed of the second roller is not more than the peripheral speed of the second gear.

16. An image forming apparatus according to claim 15, wherein the drive switching portion is a one way clutch configured to interrupt drive transmission to the second roller by the second gear in a case that the second roller and the second gear are rotated in opposite directions to each other.

* * * * *